United States Patent [19]

Kieper

[11] Patent Number: 4,758,137

[45] Date of Patent: Jul. 19, 1988

[54] VANE TYPE VARIABLE DISPLACEMENT MOTOR

[76] Inventor: Reinhold R. Kieper, 15685 Hanfor, Allen Park, Mich. 48101

[21] Appl. No.: 21,785

[22] Filed: Mar. 4, 1987

[51] Int. Cl.[4] ..... F03C 2/22; F04C 2/344; F04C 15/04

[52] U.S. Cl. ..... 418/26; 418/28

[58] Field of Search ..... 418/17, 24–26, 418/28

[56] References Cited

U.S. PATENT DOCUMENTS

| | | | |
|---|---|---|---|
| 1,527,685 | 2/1925 | Howiler | 418/28 |
| 1,603,437 | 10/1926 | Wingquist . | |
| 1,914,090 | 6/1933 | Hamilla et al. | 418/26 |
| 2,307,851 | 1/1943 | Musick et al. . | |
| 2,371,922 | 3/1945 | Saito . | |
| 2,775,946 | 1/1957 | Hufferd | 418/26 |
| 2,925,785 | 2/1960 | Sander | 418/28 |
| 3,250,223 | 5/1966 | Krawacki | 418/28 |
| 3,740,954 | 6/1973 | Young . | |
| 3,889,775 | 6/1975 | Luscher . | |
| 4,011,722 | 3/1977 | Drake . | |
| 4,087,218 | 5/1978 | Chapman | 418/259 |
| 4,265,592 | 5/1981 | Carlini . | |
| 4,503,928 | 3/1985 | Mallen-Herrerd et al. | 418/28 |
| 4,557,665 | 12/1985 | Szczupak . | |

FOREIGN PATENT DOCUMENTS

| | | | |
|---|---|---|---|
| 88624 | 1/1957 | Norway | 418/28 |

*Primary Examiner*—John J. Vrablik

*Attorney, Agent, or Firm*—Cullen, Sloman, Cantor, Grauer, Scott & Rutherford

[57] ABSTRACT

A vane type variable displacement motor comprising a body having an elliptical first bore, end caps with axial bores, an axial drive shaft journaled therethrough and a rotor on the shaft. A plurality of radial vanes are movably mounted upon and around the rotor and are biased toward the first bore and react to pressurized liquid delivered through intake and exhaust passages in the body. Rotative pistons upon the shaft within the end cap bores have a series of radial slots to receive the vanes whereby the pistons are adapted for axial movement relative to the vanes into the first bore for modifying the effective internal volume of the first bore and speed of shaft rotation. Pilot ports in the end caps are connected to a variable pressure source for biasing the pistons variably into the first bore.

6 Claims, 2 Drawing Sheets

VANE TYPE VARIABLE DISPLACEMENT MOTOR

FIELD OF THE INVENTION

The present invention is directed to a vane type variable displacement motor having a cylindrical body with means for modifying the internal volume and corresponding speed of rotation of a drive shaft driven by a source of pressurized liquid.

RELATED APPLICATION

Copending patent application Ser. No. 897,414 filed Aug. 18, 1986.

BACKGROUND OF THE INVENTION

Heretofore, various types of variable displacement motors and pumps have been provided, some of the vane type and wherein various means have been employed for modifying or regulating pump or motor displacement. Examples of prior art patents involving adjustable vane type pumps and variable speed transmissions, couplings, hydraulic drives and other pump and an apparatus and turbine constructions are shown in one or more of the following United States Patents:

THE PRIOR ART

| U.S. Pat. No. | Patent Date | Patentee |
|---|---|---|
| 1,603,437 | October 19, 1926 | S. G. Wingquist |
| 2,307,851 | January 12, 1943 | G. N. Music et al |
| 2,371,922 | March 20, 1945 | K. Saito |
| 3,740,954 | June 26, 1973 | Young |
| 3,889,775 | June 17, 1975 | Luscher |
| 4,011,722 | March 15, 1977 | Drake |
| 4,265,592 | May 5, 1981 | Carlini |
| 4,557,665 | December 10, 1985 | Szczupak |

SUMMARY OF THE INVENTION

An important feature of the present invention is to provide a vane type variable displacement motor whose speed can be changed by varying the size and volume of the chamber within which the rotor and vanes turn.

It is an important feature to provide a vane type variable displacement motor having a cylindrical body with a transversely elliptical bore with centrally apertured end caps and a drive shaft axially extending through the body and journaled through the end caps and mounting a cylindrical rotor spaced from the bore. A plurality of elongated radial vanes project through the rotor and are movably biased toward the bore and respond to pressurized fluid pumped through the body through an intake passage and out an outlet passage effecting rotation of the drive shaft. At least one rotatable piston is mounted upon the shaft within a cylindrical bore in one end cap and has a series of radial slots therein to cooperatively receive the vanes whereby the piston is adapted for axial movement within the cylindrical bore and elliptical bore relative to the vanes for modifying the internal volume of the body and accordingly the speed of rotation of the shaft.

An important feature is to provide within said body at its opposite ends within said end caps respectively a pair of rotatable pistons mounted upon said shaft, each piston having a series of radial slots cooperatively receiving the vanes whereby the respective pistons are adapted for axial movements into the elliptical bore and relative to the vanes for modifying the effective internal volume of the body and the speed of rotation of the shaft, assuming that there is a steady supply of pressurized fluid, such as oil, delivered to the motor from a suitable pump.

Another feature is to provide within the end caps pilot ports connectable to a variable pressure source by which pressure applied to the outer end of the respective pistons overcomes the internal pressure of the pressure fluids passing through the motor body such as will effect inward movement of the respective pistons into the elliptical bore whereby the volume of fluid displaced per revolution is reduced so that with a uniform supply of pressurized liquid coming into the motor the speed of the shaft will increase.

Another important feature includes means by which the reduction of pressure applied to the respective pistons permits the pistons to move outwardly relative to the vanes so as to increase the internal volume of fluid displaced so that with a uniform supply of pressurized liquids coming into the motor the speed of the shaft will be reduced.

As an important feature of the present invention there is provided an annular rotor upon the interior of the motor body spaced from the end caps and from the internal bore and wherein within a series of radial or non-radial angular slots within the rotor there are yieldably positioned a series of vanes which may move radially of the shaft to said bore.

As an important feature the corresponding rotary pistons upon the drive shaft have corresponding radial or angular slots therein adapted to cooperatively receive end portions of the corresponding vanes so that upon application of pressure to pilot ports upon the end caps, the respective pistons will move inwardly from the end caps partly into the elliptical bore reducing the total volume upon the interior of the motor body consequently increasing the speed of rotation of the drive shaft.

As an important feature there is provided as a pressure source for the present motor a pump driven from an external power source which could be from the motor of an internal combustion engine, for illustration, and wherein the pump has an outlet for delivery to the intake passage of the motor body for application to the respective vanes upon the rotor and shaft and for exhausting through a corresponding exhaust passage in said body for return to a sump in turn connected to the intake of said pump by which pressurized liquid, such as oil, is delivered at a uniform pressure and quantity to and through the body of the motor for application to the vanes and for driving the rotor at a predetermined speed.

As a further feature, pilot ports are provided in the end caps of the motor body adapted for connection to a variable source of pressurized liquid as for example the hydraulic pump and wherein adjustable control valves are interposed into the conduits to said ports for selectively modifying the pressure of liquid delivered to the respective pistons which is sufficient to overcome the internal liquid pressure of said motor, which causes inward positioning of the respective pistons into the elliptical bore, in turn reducing the total effective volume and displacement of liquids within the motor and increasing the speed of rotation of the driven shaft.

These and other objects and features will be seen from the following specification and claims in conjunction with the appended drawings.

THE DRAWINGS

It will be understood that the above drawings illustrate merely a preferred embodiment of the invention, and that other embodiments are contemplated within the scope of the claims hereafter set forth.

DETAILED DESCRIPTION OF AN EMBODIMENT OF THE INVENTION

Figure 1:
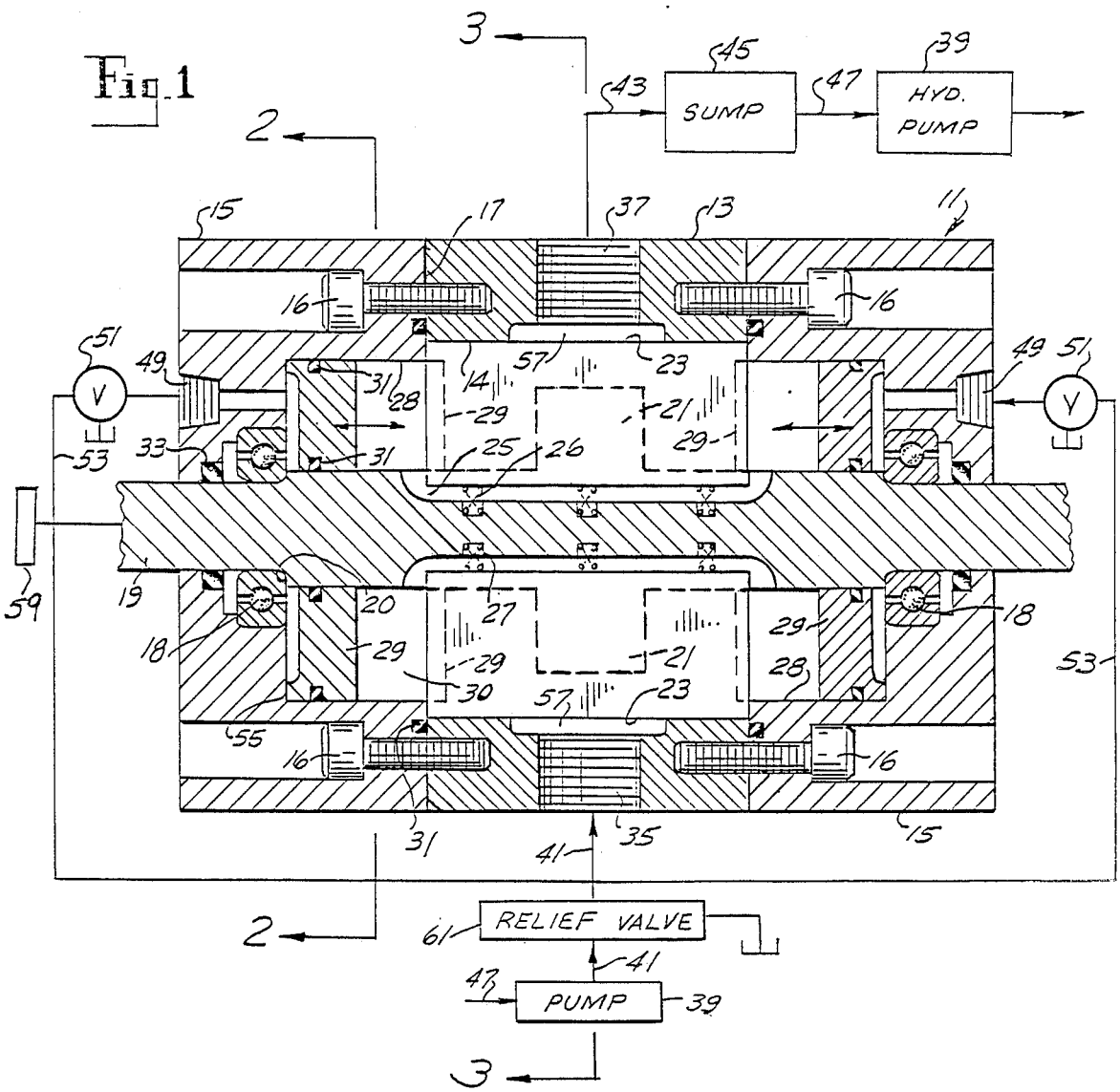
FIG. 1 is a longitudinal section of the present vane type variable displacement motor with the hydraulic connections shown schematically.
Figure 2:
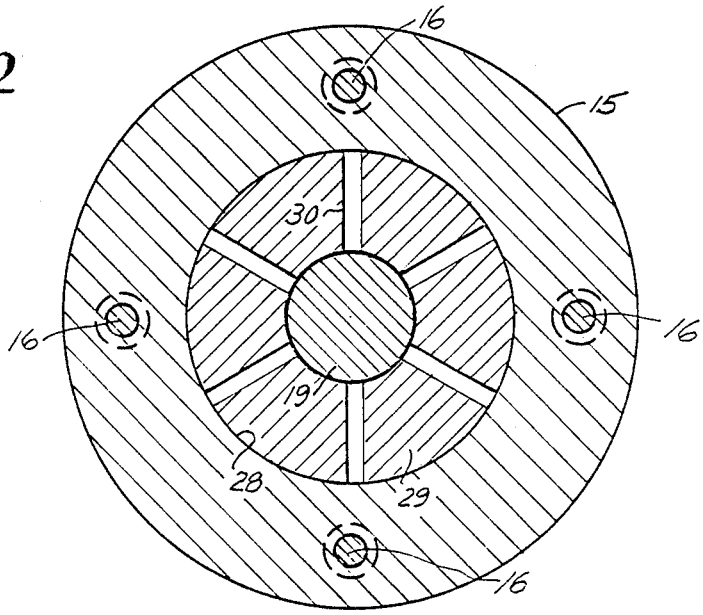
FIG. 2 is a section taken in the direction of arrows 2—2 of FIG. 1.
Figure 3:
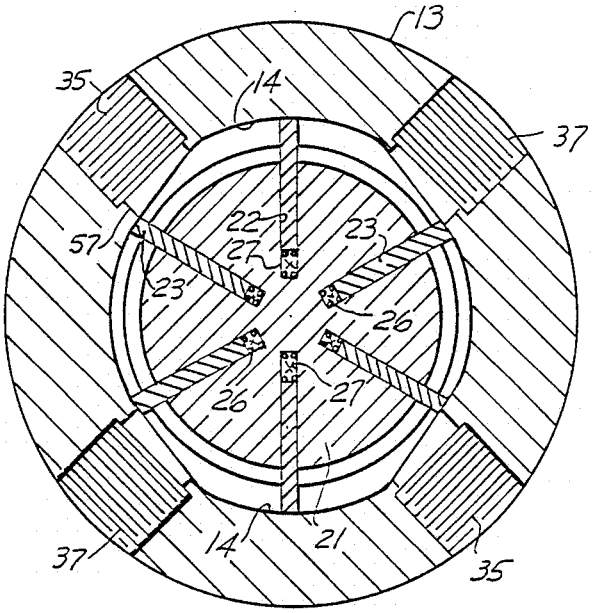
FIG. 3 is a section taken in the direction of arrows 3—3 of FIG. 1.

The present vane type variable displacement motor 11 is shown in FIGS. 1, 2 and 3, and includes a cylindrical body 13 having an elliptically shaped bore 14 and at its opposite ends apertured end caps 15 secured thereover by fasteners 16. Each of the end caps includes a radial face 17 engaging the corresponding end face of body 13 and sealed thereto at 31.

Spaced ball bearings 18 are nested and retained within end caps 15 on the interior thereof and are adapted to cooperatively receive, support and journal elongated drive shaft 19, fragmentarily shown. The drive shaft 19 is adapted to do work of any nature as for example it may be a part of a continuously variable transmission, (CVT) for a vehicle, for illustration, though not limited thereto. Any other bearings such as roller bearings or needle bearings may be used.

Intermediate the ends of drive shaft 19 are a pair of increased diameter end thrust shoulders 20 upon the interior of end caps 15 and in registry with ball bearings 18. Said shoulders are adapted to restrain shaft 19 against end wise movement relative to said body and end caps. Rotor 21 is part of drive shaft 19 intermediate its ends and is spaced from bore 14 and from end caps 15.

A series of radial slots 22, FIG. 3, are formed longitudinally through said rotor and are adapted to receive the corresponding radial vanes 23, of rectangular shape which extend therethrough. Said vanes are normally spaced from central cut away portions 25 in the shaft 19 and extend radially outward for engagement with elliptical bore 14. The respective vanes are normally biased radially outward by a plurality of springs 26 nested in recesses 27.

Rotatably mounted within the bores 28 of end caps 15 are a pair of pistons 29. Each piston has formed therethrough upon its inner side a series of radial slots 30 which correspond to radial slots 22 in rotor 21. Corresponding ends of vanes 23 are slidably received within piston slots 30, FIG. 1, whereby the corresponding pistons are adapted for axial adjustments inwardly and outwardly with respect to chamber 14 as designated by the arrows in FIG. 1. The respective pistons 29 are sealed within bore 28 and with respect to shaft 19 by corresponding additional seals 31, and said shaft is further sealed with respect to end caps is by packing glands 33.

Upon one side of body 13 intermediate its ends, is an elongated intake passage 35 communicating with bore 14. Arranged upon the opposite side of said body is an exhaust outlet passage 37. Intake passage 35 is adapted for connection to a suitable pressure source such as hydraulic pump 39, schematically shown in FIG. 1, having an outlet 41 which is suitably connected by proper fittings to said intake passage.

The corresponding exhaust passage 37 is connected by conduit 43 to a sump 45, schematically shown, which through an additional conduit 47 is further connected to pump 39, provided for recirculation of the driving liquid, as for example oil under pressure. Pump 39 operates at a uniform pressure and delivers a uniform volume of liquids to intake passage 35 in FIG. 3 for direction upon vanes 23 and clockwise through exhaust passage 37 to said sump. Normally, the internal fluid pressure biases the pistons 29 outwardly such as to the position shown and wherein their annular abutment flanges 55 are in cooperative engaging registry with end caps 15. In FIG. 3 there is shown an additional intake passage 35 and exhaust passage 37. These are similarly connected to pump 39 and sump 45.

In view of the radial slots 30 within inner end portions of the corresponding pistons 29, the respective pistons are adapted for inward movements along shaft 19 and into elliptical bore 14 of body 13.

This is achieved by applying pressurized fluid to a variable degree to the respective pilot ports 49 in the corresponding end caps 15. This pressure is under the variable control of control valves 51 connected by conduits 53 to the corresponding pump output conduit 41.

Referring to FIG. 1, valve 51 is a manually operated pressure control valve. It can actually reduce line pressure by draining it through a conduit back to sump 45. By line pressure is meant the pressure that is available in conduit 53, which is determined by the resistance or load applied to shaft 19. Line pressure can be anywhere from 0 to 500 PSI, depending on the resistance that shaft 19 encounters. If valve 51 is set at zero pressure, the piston 29 will be forced against end cap 15 by the pressure of fluid passing through bore 14 during normal operation of motor 11. If there is a need or desire to increase the speed of rotation of shaft 19, valve 51 is manually adjusted to increase the pressure against piston 29 until it overcomes the internal pressure and biases piston 29 toward rotor 21, resulting in an increase in speed. The actual speed of the shaft can be determined by using a hand-held tachometer, of which several types are available and commonly used in industry. When the desired speed has been reached, valve 51 can be adjusted so that the force against both sides of piston 29 is equal and the speed will remain constant. The speed of motor shaft 19 can then be reduced by manually adjusting the pressure of valve 51, so that the force in bore 14 biases piston 27 away from the rotor 21, resulting in a decrease in speed of rotation of shaft 19. Valve 51 is a manually operated control valve that acts in response to the operator's need to adjust the speed of rotation of motor shaft 19.

In normal operation, with some pressure drop upon the interior of body 13 and with full pressure applied through conduits 53 to pilot ports 49 there will be such sufficient pressure as to cause some inward positioning of the respective pistons 29 inwardly of the positions shown in FIG. 1. This produces a reduction in the internal effective working volume or displacement of fluids within elliptical bore 14. With a uniform continuous volume of liquid from pump 39, the speed of rotation of shaft 19 will increase. Thus, speed regulation of shaft 19 may be obtained by modifying pressure applied to pistons 29 through control valves 51. In an illustrative embodiment the volume of pressurized fluid flow into elliptical chamber 14 may be five gallons per minute, so that by reduction of the internal volume of bore 14 within body 13, the size of the chamber has been reduced and the speed of rotation increased.

By applying sufficient pressure through the pilot ports 49 in the end caps to the respective pistons 29, the volume of fluid displaced per revolution is reduced. Thus, with a uniform volume of pressurized oil coming into the motor from pump 39, the speed of the shaft will increase. As the respective pistons 29 move inwardly from the position shown in FIG. 1, there is a gradual increase of speed of rotation of shaft 19. Accordingly, by modifying and manually controlling the pressure supplied to pilot ports 49 by the pressure control valves 51, such as gradually reducing such pressure, the pistons 29 will move outwardly. This will result in a gradual decrease in speed of rotation of the shaft.

In the illustrative embodiment, upon the interior of body 13 adjacent bore 14 and outwardly thereof there is provided an elongated annular groove 57 which communicates with the respective intake passage 35, exhaust passage 37 and the corresponding vanes 23 along their length for increased responsiveness to the fluids directed into and through said motor body.

While the respective vanes 23 are shown as radial vanes, it is contemplated that instead of radial, the vanes could be nested within angular slots. The present output shaft 19 for the vane type variable displacement motor would be particularly adaptable as a part of a CVT for a vehicle such as in the automotive industry, through not limited thereto.

While six vanes are shown in FIG. 3, it is contemplated that the number of vanes could be increased or decreased. While the vanes are uniformly spaced, they could be variably spaced.

The pressure control valves 51, FIG. 1, can be set to increase or decrease pressure to be applied to the respective pistons 29, within motor bore 14. If the pistons move inwardly the speed of rotation of shaft 19 increases. If the pistons move outward from an inner position, the speed of rotation of shaft 19 is decreased due to the increased internal volume of elliptical bore 14.

In the illustrative embodiment, the pump has a capacity of 5 gallons per minute at 1000 RPM, and recommended operating pressure not to exceed 500 pounds per square inch. In the illustrative embodiment, pump 39 may be driven by an internal combustion engine on a vehicle and the shaft 19 could be a part of a continuously variable transmission.

A pressure relief valve 61 is connected into pump outlet pipe 41 for limiting the pressure of pressurized hydraulic fluids in this system, FIG. 1. Valve 61 will respond to an overload of the motor, by exhausting excess pressure. In FIG. 3, body 13 has a pair of diametrically opposed intake passages 35 and opposed exhaust passages 37. This provides for an improved balance of pressure upon rotor 21, FIG. 1, from opposite sides of the motor.

MODIFICATION

Figure 4:
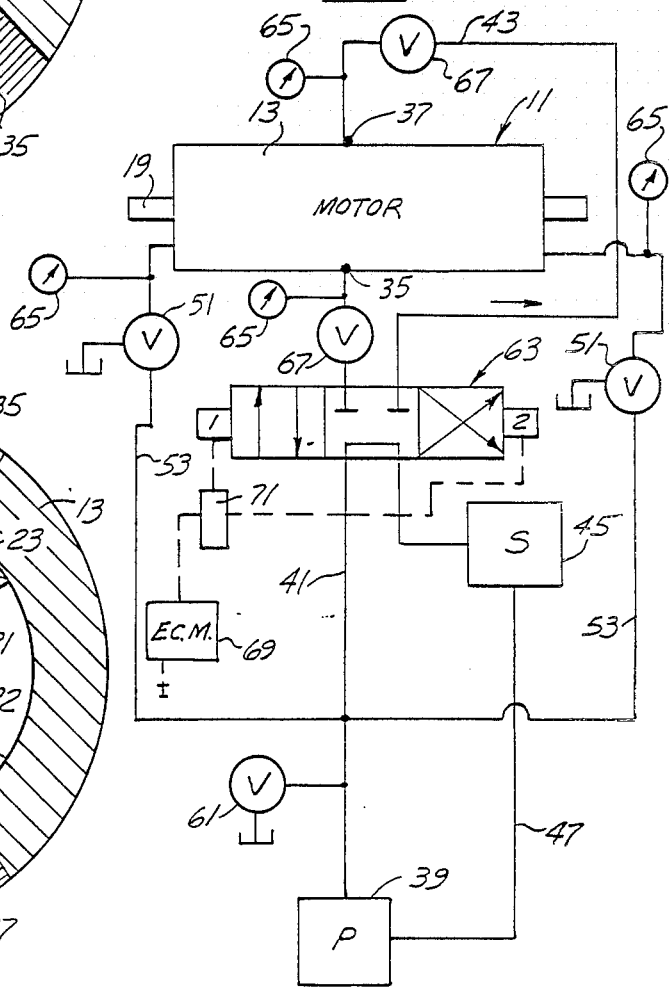
FIG. 4 is a modified hydraulic diagram including the motor of FIG. 1.
Figure 5:
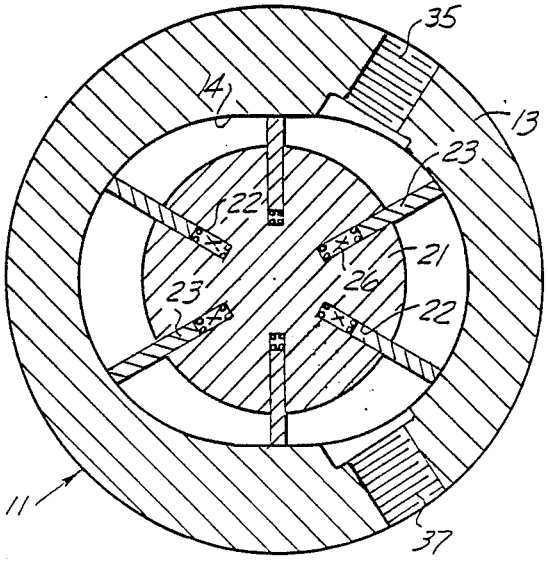
FIG. 5 is a view similar to FIG. 3 of a modified motor body with single intake and exhaust passages.

A modified hydraulic diagram is shown in FIG. 4 wherein a directional control valve 63 is connected to pump 39 and exhaust sump 45. Remote controlled solenoids 1 and 2 control the movable valve element in the valve so that pressurized liquid delivered to intake passage 35 may be reversed for delivery to the exhaust passage 37. Rotor 21 and shaft 19 will rotate in the opposite direction. Exhaust liquid from passage 35 returns to said pump.

If the shaft 19 of the vane type variable displacement motor 11 were connected to a prime mover 59 (as shown in FIG. 1), and the outlet 37 in FIG. 3 connected to a reservoir or sump 45, fluid would be drawn from the reservoir into chamber 14. It would be put under pressure as it passes clockwise through the narrowed chamber as driven by the vanes 23, and then released through inlet 35. The function of the motor is thereby changed to that of a pump.

Some of that pressurized fluid from the outlet would be channelled back through pressure control valves 51 to the pilot ports 49 at the ends of the pump to bias the rotative pistons 29 inward. By adjusting the pressure control valves 51, the displacement of the pump can be changed.

The present vane type variable displacement motor could be used as an integral part of a continuously variable transmission (CVT). It would thus be possible to build a CVT using a pair of vane type variable displacement motor/pumps; one acting as a pump and the other acting as a motor.

Vane end play is prevented by the reduced diameter piston chambers 28, FIG. 1. The vanes are variably biased outwardly by the springs 26 and centrifugal forces towards engagement with elliptical bore 14, FIG. 3. The hydraulic circuit in FIG. 1 and FIG. 4 is illustrative of two embodiments of the present invention, and can be modified to meet changing conditions. While six vanes 23 are shown, two or more may be employed.

While chamber 14 is shown as elliptical in form it could be of a different form as out of round. The present motor 11, or pump preferably shows a pair of rotative pistons 29. It could function with only one such piston. The present motor could have three inlets and three opposed outlets.

Conduits 53 in FIG. 4 interconnect pump outlet 41 and the respective pilot ports 49 on motor 11, as shown in FIG. 1. Pressure control valves 51 are interposed in conduits 53 and drain into sump 45. Adjustable pressure relief valve 61 is connected into pump outlet pipe 41 and drains into sump 45.

Solenoid controlled valves 67 are interposed respectively in pipe 41 to motor inlet 35 and in pipe 43 connected to outlet 37. Pressure gages are shown at 65 in pipes 53, 43, and 41.

ELECTRONIC CONTROL SYSTEM

Referring to FIG. 4, if the vane type variable displacement motor 11 were affixed to the frame of a vehicle, and shaft 19 were splined to a wheel of that vehicle, motor 11 would act as a transmission under the following circumstances. The original transmission of that vehicle would be removed, and in its place there would be a hydraulic pump 39 connected to the engine. There would be a sump 45 for the pump to draw oil from. The pump could have a capacity of delivering 5 gallons per minute at 1000 RPM.

Valve 61 can be manually set to exhaust pressure that exceeds 500 PSI. The output of the pump would be connected by conduit 41 to valve 63, which can be controlled by the gear shift lever of that vehicle. There would be an electronic control module 69 (ECM) that would be electrically connected to the gear shift lever 71 and solenoids 1 and 2 of valve 63. The ECM would also monitor and control engine speed, and also monitor road speed and throttle position.

Valves 51, and valves 67, are actually modulated digital signal (MDS) solenoids whose function is different because of their being piped differently. (A MDS solenoid is a solenoid whose shaft blocks a passageway when it is in the "on" position. This solenoid can be cycled "on" 100 times a second, for illustrative purposes, and the duration of each "on" cycle can be controlled. By controlling the time or width of each cycle, the amount that the passageway is blocked can be controlled in finite increments.)

In FIG. 4, there are four gages 65 (electrical connections not shown), which are pressure transducers that will transmit to the ECM 69 what the instantaneous pressure is in each of those four places. The MDS solenoid, valves 51, block the path for the oil to pass to the sump, when the valve is in the on position. In this way valve 51 controls the pressure that biases the pistons toward the rotor. The MDS solenoid valve 67 will block the rate of flow of fluid in conduit 41 and 43, when it is in the on position.

To recap, the ECM 69 will know what the pressure is at the end caps 15, and in two places of chamber 14. The ECM will know the engine speed, the road speed, the throttle position, and the gear shift position. The ECM will be able to control valves 51, valves 67, and the engine speed. All the aforementioned devices are hooked up to the ECM electrically (not shown in FIG. 4). The ECM, schematically shown at block 69, FIG. 4, will have memory space that can be programmed with different parameters for the operation of the vehicle. For instance, these software parameters can be changed so that the vehicle could accelerate swiftly or gradually.

Here is how the proposed ECM would control a vehicle. The driver would start the engine, which would idle at 1000 RPM. The driver would then move the gear shift lever 71 to drive, and the ECM would send a signal to valve 63 to shiift to position one. This would cause 5 gallons per minute to pass into inlet 35. Pressure would increase in bore 14 until it overcame the resistance of shaft 19 to turn. The vehicle would begin to move. The driver would press on the throttle which would increase engine RPM, causing more gallons per minute to go through motor 19, in turn increasing vehicle speed.

The ECM, which would have been pulsing valve 51 to keep the pressure against port 49 lower than the pressure in bore 14, would now pulse valve 51 to the 100% "on" condition so that the drain would be blocked, increasing pressure to port 49, biasing piston 29 inward, and increasing vehicle speed. The ECM could cause one or both pistons 29 to move inward, to increase speed gradually or swiftly. When the desired road speed is reached, as determined by the ECM from the throttle position input, valve 51 would be pulsed at least than 100% so thatthe piston 29 would remain in a fixed axial position and vehicle speed would remain constant.

If the vehicle were to go down a hill, a decrease in pressure in bore 14 would be detected, and the ECM could pulse valve 51 so that pressure at port 49 is reduced proportionally and speed would remain constant. If the incline that the vehicle is going down in steep, valve 67 that is on the outlet 37 side, could be pulsed so that the flow of oil is reduced which would "brake" the motor 19. The oil that is not permitted past valve 67 would be exhausted at relief valve 61.

If the vehicle were to encounter a hill that it must climb, the ECM would detect an increase in pressure in bore 14. The ECM would adjust engine speed and valve 51 proportionally, so that vehicle speed would remain constant. The pressure in the system is determined by the load that shaft 19 must push. On level ground that load is constant and the ECM would maintain a constant engine speed. The ECM could be programmed to operate in a fuel efficient manner or a sporty manner. The ECM could be programmed for different vehicle size and weight, and different engine size. If a smooth shift is desired from neutral to drive, valve 67 on the inlet 35 side could be pulsed in a manner that would gradually feed the oil to bore 14.

When the desired road speed has been reached, the ECM would reduce motor 11 volume to the minimum while reducing engine speed (hence reducing gallons/-minute), so that minimal energy output would be used to keep the vehicle rolling. Valve 67 on the inlet 35 side of motor 11 could be used to accelerate motor 11 rapidly by momentarily interrupting the flow of oil to the motor 11, which would assist the inward movement of pistons 29.

The proposed control system as shown hydraulically in FIG. 4 is an alternative to the manual system of FIG. 1.

Having described my invention, reference should now be had to the following claims.

I claim:

1. A vane type variable displacement motor comprising a cylindrical body having an elliptical first bore;

centrally apertured end caps secured upon said body sealing said bore and including an internal axial bore communicating with said first bore;

a drive shaft axially extending through said body and end caps and journaled and sealed upon said end caps;

a cylindrical rotor upon said shaft spaced from said first bore and having a series of radial slots around its periphery;

a plurality of elongated radial vanes slidably projected through said slots for radial adjustments and adapted to engage said first bore;

there being an intake passage in said body for directing pressurized liquid to said first bore and vanes from a pressure source, and an outlet passage for receiving exhaust liquid from said first bore;

a rotatable piston mounted upon said shaft within one end cap bore and having a series of radial slots therein cooperatively receiving said vanes, whereby said piston is adapted for axial movements within said end cap and into said first bore and relative to said vanes for modifying the effective internal volume of said elliptical bore and the speed of rotation of said shaft, the pressure of liquid flowing through said body normally biasing said piston outwardly;

there being a pilot port in the end cap communicating with said axial bore adjacent said piston;

and variable pressure means connected to said pilot port biasing said piston inwardly of said end cap and variably into said elliptical bore;

said variable pressure means including a conduit interconnecting said pressure source and said pilot port; and an adjustable pressure control valve in said conduit.

2. In the variable displacement motor of claim 1, a second rotatable piston upon said shaft within the other end cap bore and having a series of radial slots therein cooperatively receiving said vanes, whereby said second piston is adapted for axial movements within said other end cap bore and into said first bore and relative to said vanes;

pressure of liquid flowing through said first bore normally biasing said second piston outwardly;

there being a second pilot port in the other end cap communicating with said axial bore adjacent said second piston;

said variable pressure means being connected to said second pilot port biasing said second piston inwardly of said second end cap and variably into said elliptical bore;

said variable pressure means further including:

a second conduit interconnecting said pressure source and said second pilot port; and an adjustable pressure control valve in said second conduit.

3. In the variable displacement motor of claim 1, a pressure relief valve connected to said pump outlet for varying the maximum pressure of liquids to said motor.

4. In the variable displacement motor of claim 1, a remote controlled four-way valve interposed between the pump outlet and said motor intake and exhaust passages whereby the flow of pressurized fluids through said motor may be reversed between said intake and outlet for reversing rotation of said shaft.

5. A vane type variable displacement motor comprising a cylindrical body having an elliptical first bore;

centrally apertured end caps secured upon said body sealing said bore and including an internal axial bore communicating with said first bore;

a drive shaft axially extending through said body and end caps and journaled and sealed upon said end caps;

a cylindrical rotor upon said shaft spaced from said first bore and end caps and having a series of angular slots around its periphery;

a plurality of elongated angular vanes slidably projected through said slots for radial movements and adapted to engage said first bore;

there being an intake passage in said body for directing pressurized liquid to said first bore and vanes from a pressure source, and an outlet passage for receiving exhaust liquid from said first bore;

a rotatable piston mounted upon said shaft within one end cap bore and having a series of corresponding angular slots therein cooperatively receiving said vanes, whereby said piston is adapted for axial movements within said end cap bore and into said first bore and relative to said vanes for modifying the effective internal volume of said elliptical bore and the speed of rotation of said shaft;

pressure of liquid flowing through said body normally biasing said piston outwardly;

there being a pilot port in the end cap communicating with said axial bore adjacent said piston;

a conduit interconnecting said pressure source and said pilot port; and an adjustable variable pressure control valve in said conduit for biasing said piston inwardly of said end cap and variably into said elliptical bore; and wherein the modifying of the internal volume of said first bore maintains the maximum torque capabilities of the motor.

6. A vane type variable displacement apparatus comprising a cylindrical body having an elliptical first bore;

centrally apertured end caps secured upon said body sealing said bore and including an internal axial bore communicating with said first bore;

a drive shaft axially extending through said body and end caps and journaled and sealed upon said end caps;

a cylindrical rotor upon said shaft spaced from said first bore and having a series of radial slots around its periphery.

a plurality of elongated radial vanes slidably projected through said slots for radial adjustments and adapted to engage said first bore;

there being an intake passage in said body for directing liquid to said first bore and vanes from a pressure source, and an outlet passage for receiving liquid from said first bore;

a rotatable piston mounted upon said shaft within one end cap bore and having a series of radial slots therein cooperatively receiving said vanes, whereby said piston is adapted for axial movements within said end cap bore and into said first bore and relative to said vanes for modifying the effective internal volume of said elliptical bore and the speed of rotation of said shaft;

a rotative prime mover connected to said shaft, said apparatus functioning as a pump receiving liquid at its outlet passage and discharging pressurized liquid at its intake passage;

pressure of liquid flowing through said body normally biasing said piston outwardly;

there being a pilot port in the end cap communicating with said axial bore adjacent said piston;

a conduit interconnecting said pressure source and said pilot port; and an adjustable variable pressure control valve in said conduit for biasing said piston inwardly of said end cap and variably into said elliptical bore.

* * * * *